US007836734B2

(12) United States Patent
Lynch

(10) Patent No.: US 7,836,734 B2
(45) Date of Patent: Nov. 23, 2010

(54) CONTOURED COMPOSITE STRUCTURE LOCKING SYSTEM

(76) Inventor: Leslie Lee Lynch, 3463 State St. #123, Santa Barbara, CA (US) 93105

( * ) Notice: Subject to any disclaimer, the term of this patent is extended or adjusted under 35 U.S.C. 154(b) by 887 days.

(21) Appl. No.: 11/691,649

(22) Filed: Mar. 27, 2007

(65) Prior Publication Data

US 2007/0191750 A1 Aug. 16, 2007

Related U.S. Application Data

(63) Continuation-in-part of application No. 11/219,086, filed on Sep. 1, 2005, now abandoned.

(51) Int. Cl.
*E05B 65/00* (2006.01)

(52) U.S. Cl. ..... 70/58; 441/74; 441/75

(58) Field of Classification Search ..... None
See application file for complete search history.

(56) References Cited

U.S. PATENT DOCUMENTS

| | | | |
|---|---|---|---|
| 4,680,949 | A | 7/1987 | Stewart |
| 4,712,394 | A | 12/1987 | Bull |
| 5,119,649 | A | 6/1992 | Spence |
| D378,987 | S | 4/1997 | Ross |
| 5,779,510 | A | 7/1998 | Skedelski |
| D416,778 | S | 11/1999 | Pitcher et al. |
| 6,688,145 | B2 | 2/2004 | Tan |
| 6,691,537 | B2 | 2/2004 | Tan |

*Primary Examiner*—Jack W. Lavinder
(74) *Attorney, Agent, or Firm*—Felix L. Fischer

(57) ABSTRACT

A contoured composite locking system incorporates an installation cup (10) mountable within a foam core structure of a foam composite surface and having means for engaging the foam core. A plug (12) is installed within the receiver cup, the plug incorporating an eyelet (18) for the shank of a restraint and a contoured cap (16) to preclude interference with or injury to a user.

14 Claims, 9 Drawing Sheets

CONTOURED COMPOSITE STRUCTURE LOCKING SYSTEM

REFERENCE TO RELATED APPLICATIONS

The present application is a continuation in part of U.S. patent application Ser. No. 11/219,086 filed on Sep. 1, 2005 having the same title as the present application the disclosure of which is fully incorporated herein by reference.

BACKGROUND OF THE INVENTION

1. Field of the Invention

This invention relates generally to the field of portable object locking systems and, more particularly, to a contoured locking system for surfboard and other watercraft or devices employing foam composite construction.

2. Description of the Related Art

Surfboards and windsurfing boards have become increasingly popular for recreational use. While graceful and easily manipulated in the water and while light weight based on foam composite construction techniques, the size and bulky form of these articles on the beach often makes it desirable to store or leave them unattended while pursuing other activities. Similar difficulties arise with other recreational water craft such as kayaks, boogie boards, knee boards or devices made from foam composite construction.

To prevent theft of these articles, various locking systems have been devised such as those disclosed in U.S. Pat. Nos. 4,712,394 to Bull issued Dec. 15, 1987 entitled Surf Lock; 4,680,949 to Stewart issued Jul. 21, 1987 entitled Locking Device for Articles Such As Sailboards: 5,119,649 to Spence issued Jun. 9, 1992 entitled Locking Device for Recreational Articles; 6,688,145 to Tan issued Feb. 10, 2004 entitled Sports Board Locking Apparatus and Method; and 6,691,537 to Tan issued Feb. 17, 2004 entitled Sports Board Locking Apparatus. However, these systems employ attachments that typically cannot be in place while the article is in use or can be lost or misplaced when not attached to the article. Additionally, these devices tend to have complex mechanical arrangements that are expensive to produce.

It is therefore desirable to have a locking system for surf boards and similar articles that can remain in place during use of the board without interfering with the user or causing potential injury. Additionally, it is desirable to have a locking system that does not require additional complex devices for use.

SUMMARY OF THE INVENTION

A contoured cap composite locking system is provided in several embodiment of the present invention. In a first embodiment, an installation cup mountable within a core structure of a composite surface and having means for engaging the core. A plug is installed within the receiver cup, the plug incorporating a toroidal eyelet for the shank of a restraint and a contoured cap to preclude interference with or injury to a user. A cylindrical body on the plug having a reduced vertical profile is received in the cup and secured by bonding a circumferential surface of the body to the cup. An upper lip of the cup is provided for engagement of the plug cap.

In an alternative embodiment, the contoured cap of the plug is terminated in a flat bottom surface adapted for direct adhesive bonding to a composite surface. A structural arch through which the eyelet extends terminates at the bottom surface for engagement with the adhesive bonding on the surface. In certain further embodiments a structural plate is embedded in the cap with rigid attachment to the arch and providing a contiguous surface with the flat bottom for engagement with the adhesive on the composite surface.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 1:
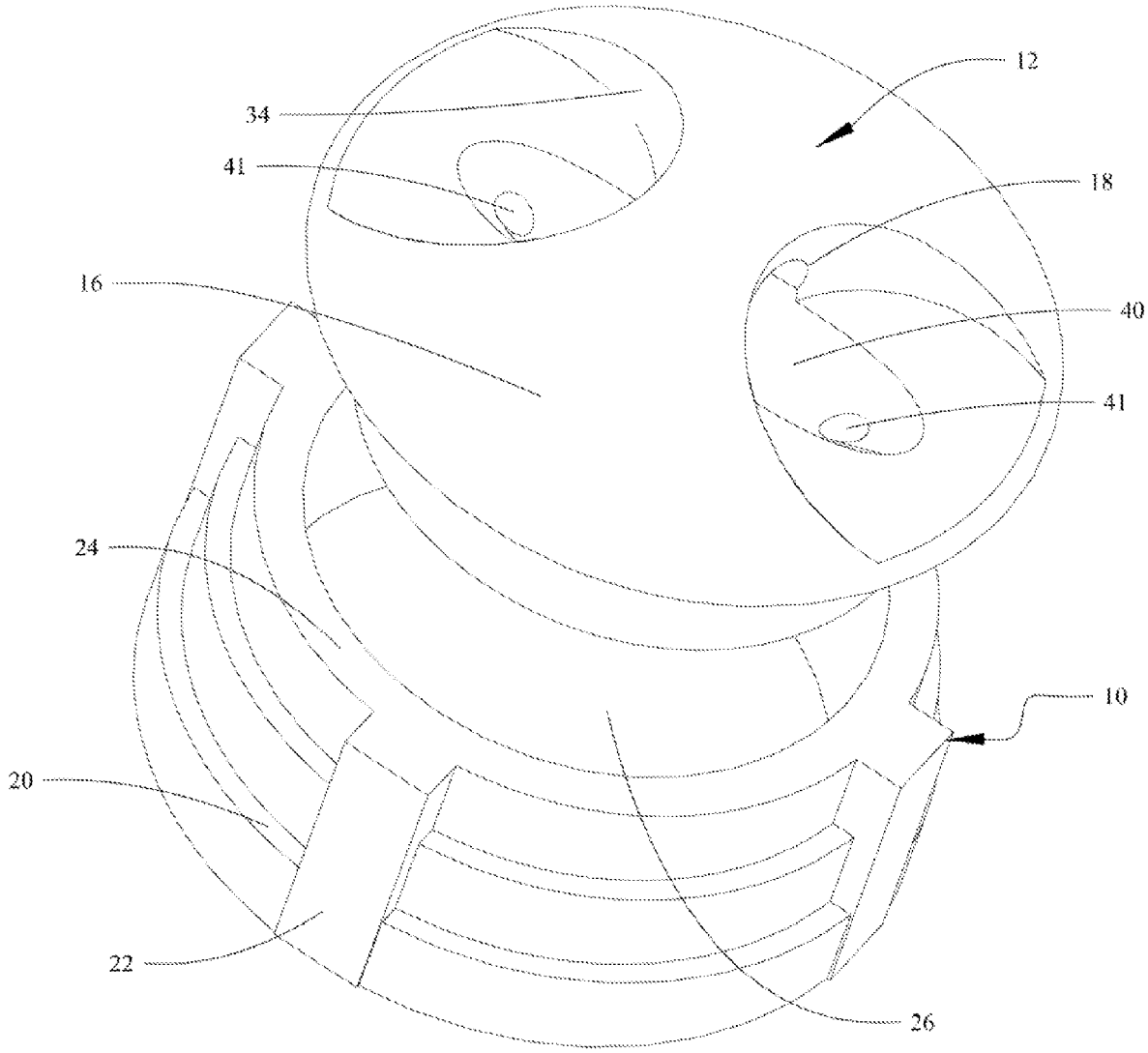
FIG. 1 is an exploded isometric view of a first embodiment of the present invention.

Referring to the drawings, the present invention is incorporated in a current embodiment shown in FIG. 1. A cup 10 is employed for mounting within the foam composite of a surfboard, as an exemplary use, during fabrication of the board. Composite structures having a core with comparable properties to foam such as balsa or structural matrix elements are employed in alternative embodiments. A plug 12 is received in the cup after fabrication of the board is complete, as will be described in greater detail subsequently. Molded into the plug is a security ring 14 for structural strength in the locking element. The plug has a contoured outer surface 16 which includes an eyelet 18 extending through the ring.

Figure 2:
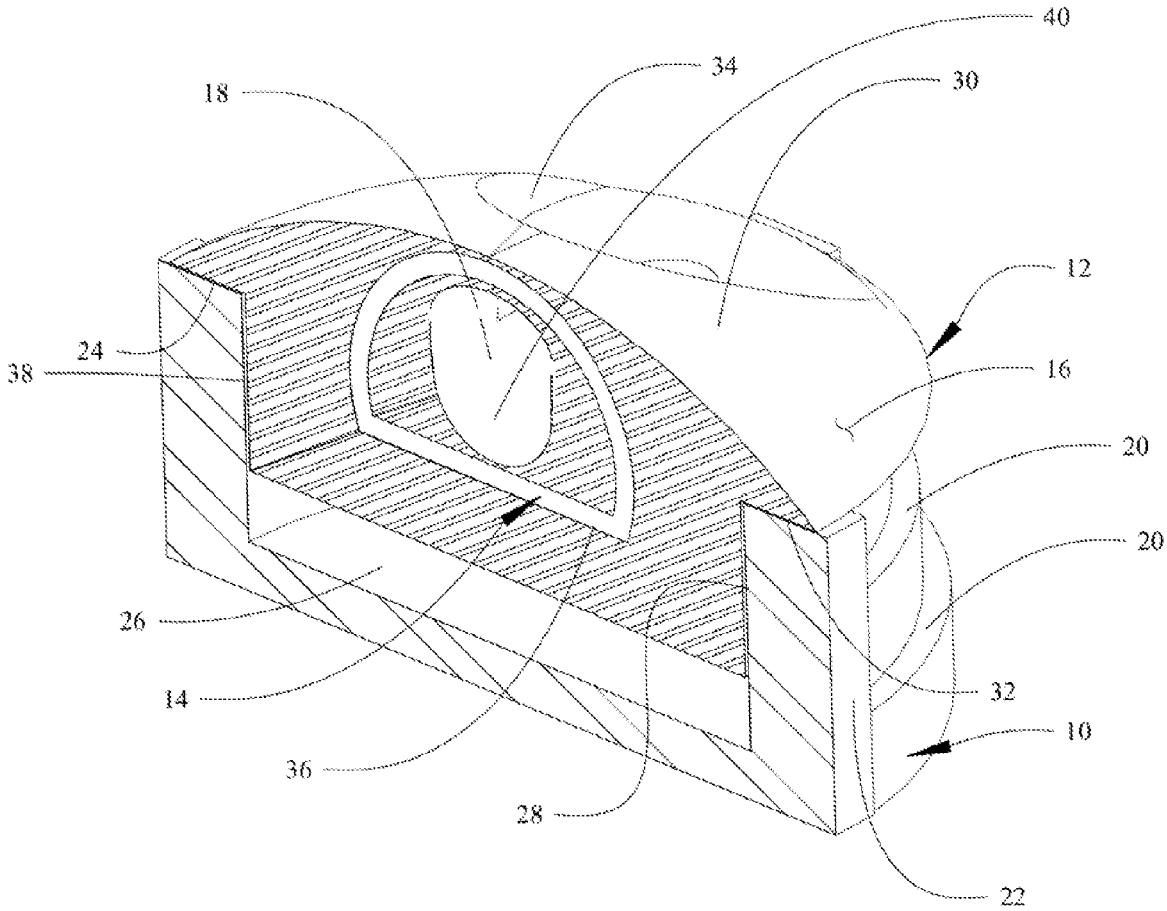
FIG. 2 is an isometric section view of the of the assembled embodiment of FIG. 1 in a plane perpendicular to the eyelet bore.

As best seen in FIG. 2, for the embodiment shown, the cup employs multiple engaging steps 20 formed by spaced reductions in the cylindrical diameter of the cup to allow the cup to be firmly secured within the foam composite structure by increasing the "pull out" area at the base of the cup with the foam or resin fill overlying the steps depending on the fabrication technique used for the board. In alternative embodiments, ribs or flanges extending from the substantially cylindrical body of the cup perform the structural function of the steps. Vertical risers 22 are incorporated in the cup to provide lateral surface area to resist rotational movement of the cup within the foam composite. Two diametrically opposed risers are shown in the exemplary embodiment in the drawings, however a single riser or other combinations of multiple risers are employed in alternative embodiments. The cup employs a flat rim 24 which can be sanded flush with the board surface during finishing without impacting the normal sanding or profiling operations for the board. The rim is of sufficient width to allow masking taping to securely adhere during finishing operations as described in greater detail subsequently. The central cavity 26 in the cup receives the plug.

Figure 3:
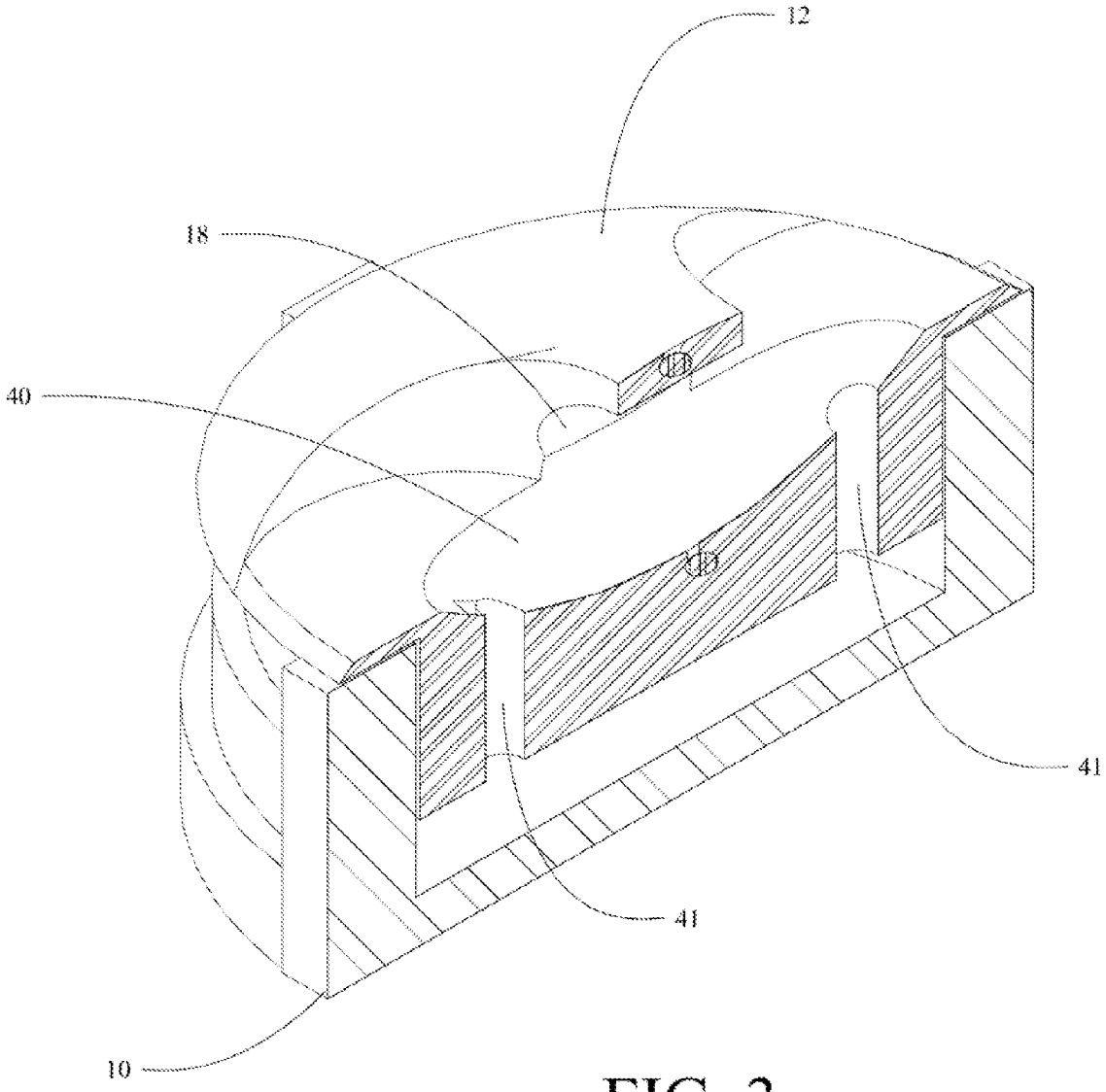
FIG. 3 is an isometric view of the embodiment of FIG. 1 in a plane perpendicular to the section of FIG. 2.

Details of the plug are also shown in FIGS. 2 and 3. A cylindrical body 28 is provided to be received in the central cavity of the cup. For the embodiment shown, the cylindrical body is recessed diametrically inward from the circumference of a cap 30 which incorporates the contoured upper surface of the plug. The land 32 projecting from the body engages the flat rim of the cup. As shown in the drawings for the present embodiment, the land extends beyond the diameter of the cup rim to engage not only the cup but a portion of the upper surface of the board. The security ring is molded into the body and cap of the plug to provide the maximum structural integrity for receiving the hasp of a standard padlock or locking cable to secure the board. The eyelet is molded into the plug to substantially cover the ring while providing the necessary opening for the lock or cable. The contoured surface of the plug is smoothly arcuate to avoid snagging on the users clothing or causing injury to skin or feet during use of the board. The eyelet additionally is employable as an attachment for a leash commonly used on surfboards thereby avoiding or replacing the requirement for a separate leash attachment point on the board. Additionally, the relieved surfaces of the cap surrounding the eyelet, nominally designated 34 are curvilinearly contoured to prevent leveraging points or surfaces where the locking hasp or cable could be used as a lever to pry the plug and cup from the surface of the board.

The security ring for the embodiment disclosed herein is shown in detail in FIGS. 2 and 3. A D-shaped ring fabricated from stainless steel is employed having a flat bottom 36 to reduce the required axial dimension of the plug and cap, however, in alternative embodiments, a circular ring or quadrilateral member are employed for the increased structural support necessary while relaxing or increasing the axial dimensional requirements respectively. Similarly, for the current embodiment, the ring is substantially circular in cross section. Alternative cross sections such as rectangular or star shaped for additional mold material engagement within the plug are employed if dictated by molding material selection.

The form and function of the elements of the present embodiment of the invention contribute to ease of integration into existing fabrication processes for the surfboards or other articles into which the locking system is incorporated. The cup and plug are molded in Polyvinyl Chloride (PVC) for the current embodiment using molding techniques with the security ring molded into the plug as known in the art. Alternative plastics such as Acrylonitrile-butadiene styrene (ABS) may be employed in alternative embodiments.

As an exemplary installation method, the normal foam core shaping of the surfboard and laminating with fiberglass or alternative covering is accomplished followed by or including drilling of a bore in the tail portion of the board having a diameter substantially equal to the base of the cup and a depth sufficient to position the flat rim at the composite surface upon surface finishing. For the drawing, the bore is shown in the foam core, however, in alternative embodiments placement of the bore in a structural member is employed. The cup is inserted into the bore with a mild interference fit or an interim adhesive bond. With a temporary plug or tape covering on the cup to avoid undesired ingress of resin into the cup, resin coating and final glassing or other structural composite skinning of the foam core is accomplished with resin matrix including the cylindrical contour of the bore filling over the steps of the cup and laterally surrounding the risers in the cup. The flat surface of the rim of the cup with no protuberances allows normal sanding or other surface finishing operations to be conducted on the board without interference. Completion of the surface finishing provides the flat rim of the cup flush with the surface of the board.

The plug is then inserted into the cup using a structural adhesive to secure the plug to the cup. As shown in the drawings, the plug incorporates relief ports 41 extending through the material of the plug for pressure relief during insertion of the plug into the cup to allow tight tolerances to be maintained between the cavity of the cup and the plug body to enhance structural integrity of the adhesive bond. The length of the plug body is less than the vertical dimension of the cavity in the cup and provides a clearance volume to allow for sanding of the cup length while assuring flush engagement of the land on the land on the plug cap with the flat rim on the cup after assembly.

Additionally, the surface of cylindrical body 28 of the plug is textured for adhesive affinity to allow the adhesive bond to engage the cylinder surface of the plug body to the cylinder wall 38 of the cup thereby placing the bond in shear rather than in tension in response to extraction force on the plug after assembly. For the embodiment shown, the cylinder wall of the cup is also textured for supplemental strength in the adhesive bond.

The reduced height of the plug body over prior embodiments and use of cylindrical surfaces for adhesive bonding allows great flexibility in sanding of the cup after assembly into the foam core during finishing. In an exemplary embodiment for use with a surfboard, a plug body length of only 0.300 inch is employed with a cap height of only 0.280. The cup with an initial depth of 0.500 can be sanded up to 0.200 inch without impacting its ability to receive the plug and allows reduction of the bore depth in the surf board core to significantly less than half the normal thickness dimension of the board.

Additionally for the embodiment shown in FIGS. 1, 2 and 3, a toroidal excavation 40 into the relieved sections of the contoured plug surface is provided in the eyelet to receive a lock hasp with greater ease than a simple cylindrical bore. The toroidal bore extends into the body of the plug allowing a further reduced overall vertical profile on the cap and contour overlaying the eyelet.

Figure 4:
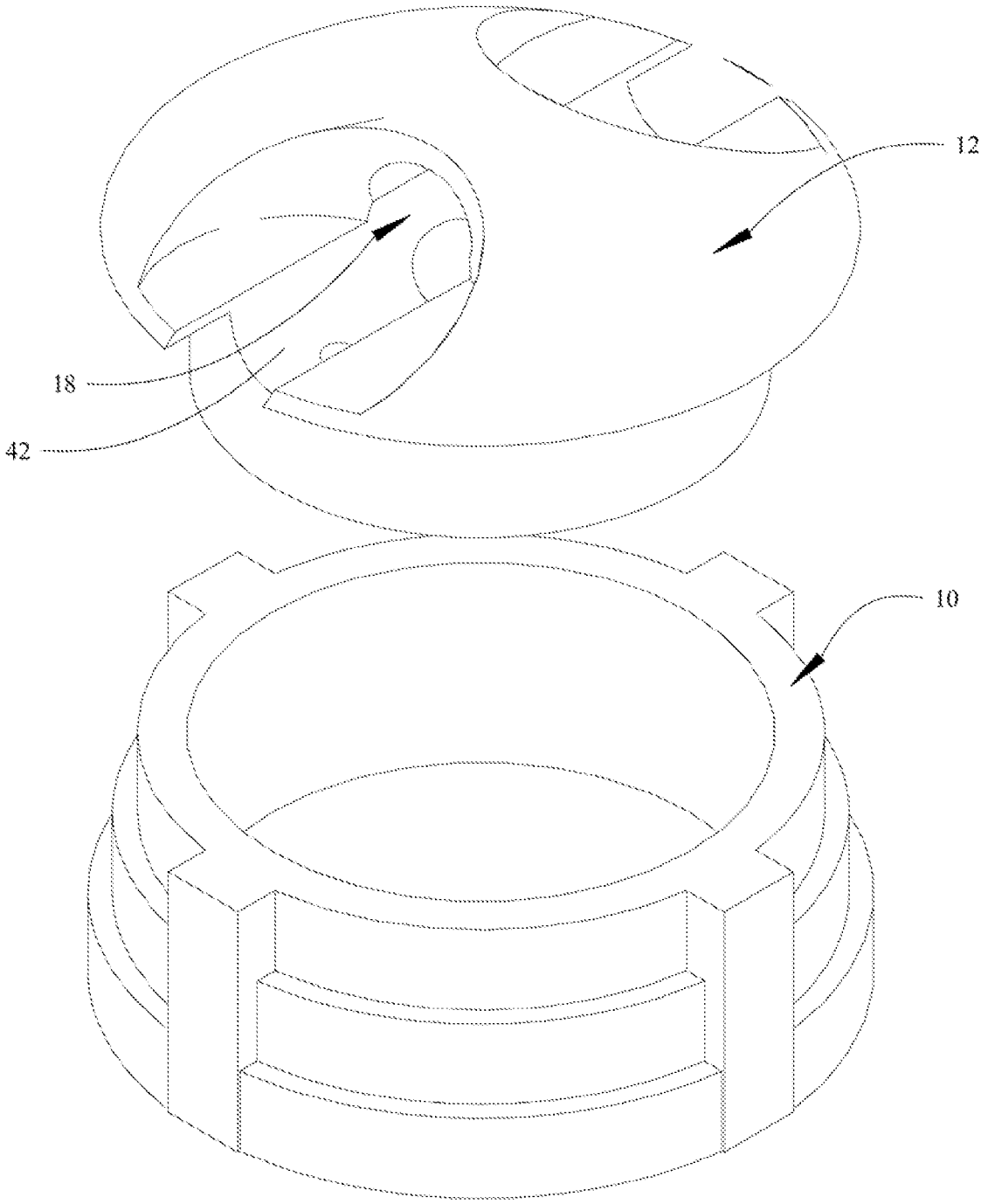
FIG. 4 is an exploded isometric view of a second embodiment of the invention incorporating a straight bore for the eyelet.
Figure 5:
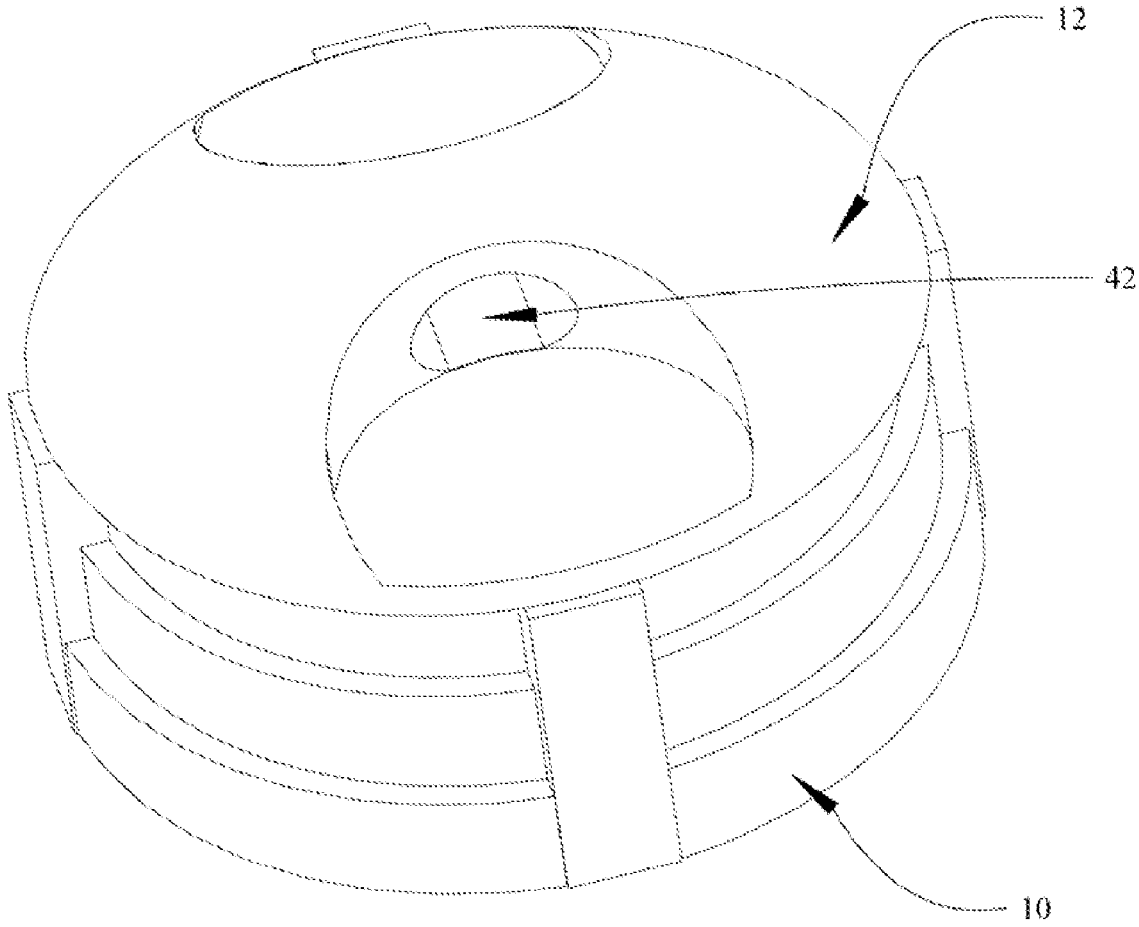
FIG. 5 is an isometric view of a small bore alternative of the second embodiment.

In an alternative embodiment shown in FIGS. 4 and 5, avoids the complexity of machining or molding the torroidal bore and provides a straight bore 42 of sufficient depth to allow clearance of the lock hasp. The bore for the embodiment shown in FIG. 4 creates a diametric break 44 in the cap rim, however, the remaining land on the rim provides sufficient bonding surface and strength for operation. Smaller bore diameters limited to and concentric with the diameter of the eyelet in alternative embodiments as shown in FIG. 5 are provided for use with small diameter hasps allows the cap rim to remain unbroken.

Figure 6:
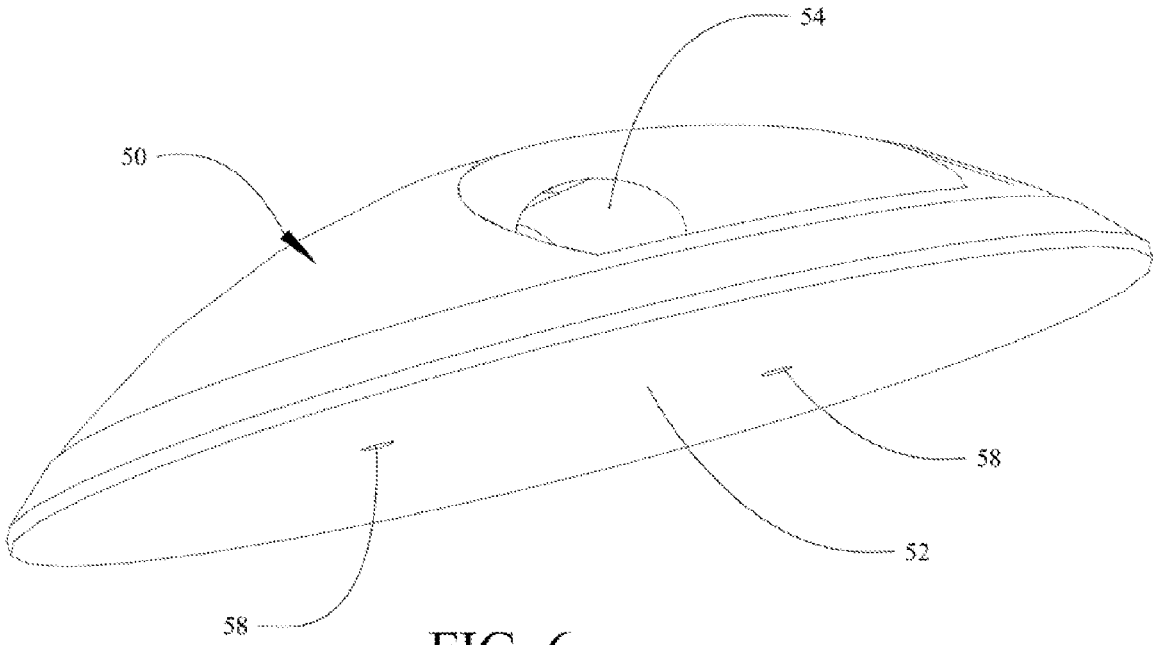
FIG. 6 is an isometric view of the truncated plug of an alternative embodiment of the invention.
Figure 7:
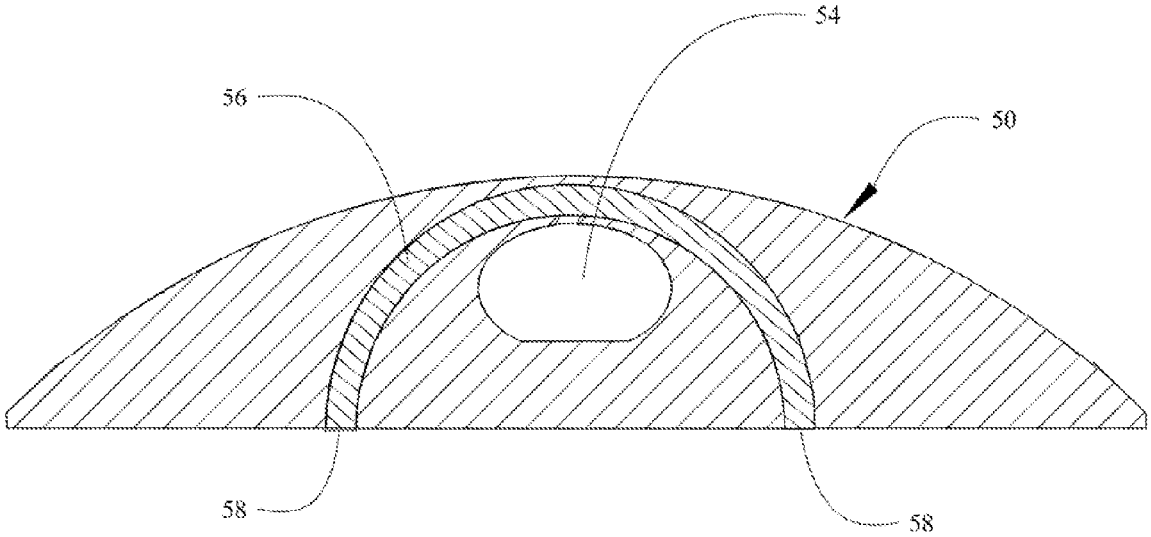
FIG. 7 is a section view of the embodiment of FIG. 6.

As shown in FIGS. 6 and 7, an alternative embodiment of the present invention provides a truncated contoured cap 50 having a flat bottom 52 for direct adhesive engagement with a composite surface. Eyelet 54 is surrounded by a structural arch 56 for increased strength to preclude breaking of the eyelet contour while in use. For the embodiment shown, the arch terminates at the flat bottom with two exposed pads 58 for direct engagements with the adhesive for mounting to the composite surface increasing the overall strength of the installed cap.

Figure 8:
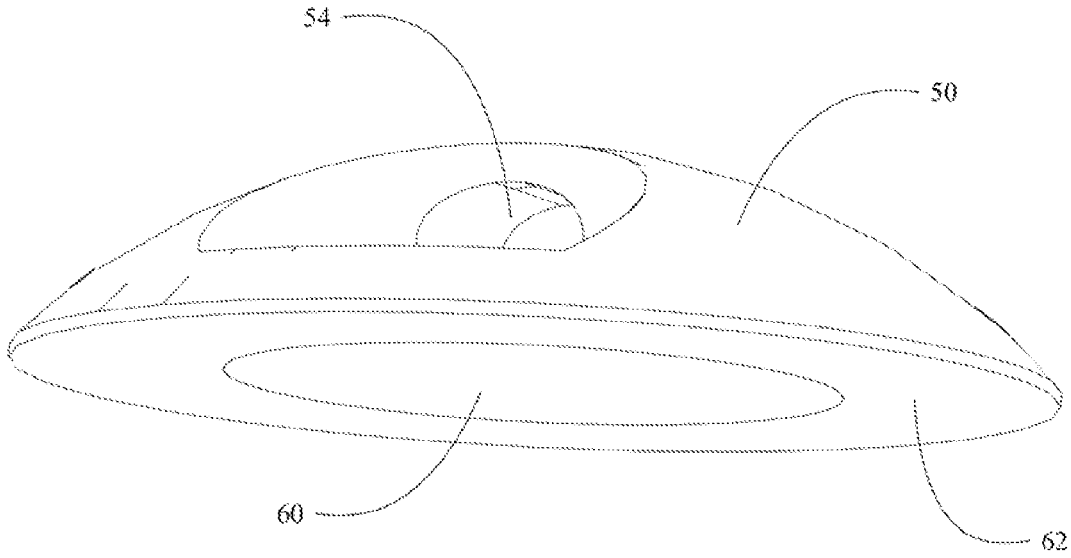
FIG. 8 is an isometric view of a modification of the embodiment of FIG. 6 incorporating a structural plate.
Figure 9:
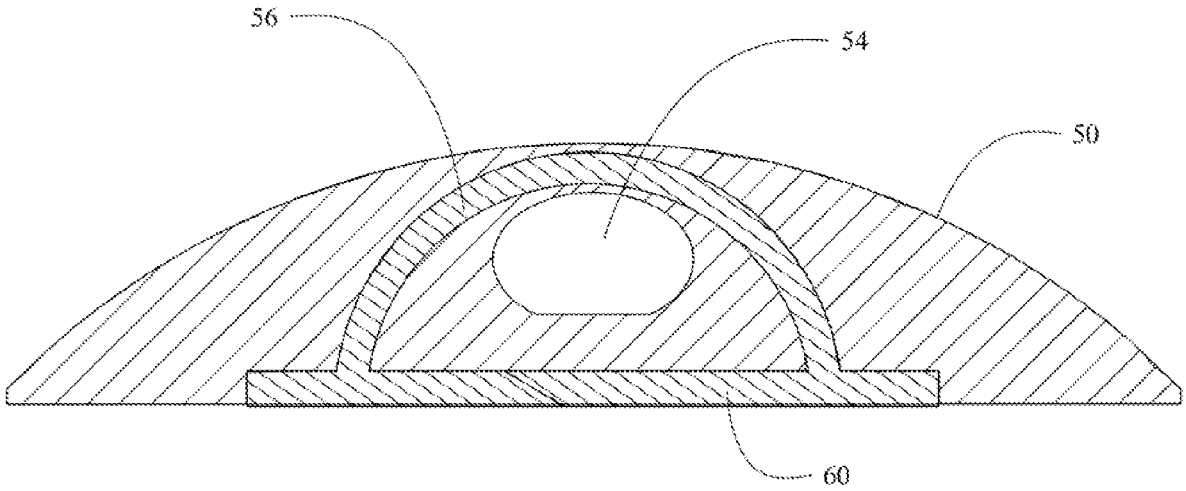
FIG. 9 a section view of the embodiment of FIG. 8.

For high strength applications, a plate 60 is embedded in the bottom of the cap as shown in FIGS. 8 and 9 providing a flush engagement along with the surrounding element 62 of the flat bottom surface for the adhesive bond to the composite surface. The structural arch is attached to the plate or integrally formed with the plate prior to insertion into the mold for fabrication of the cap.

Figure 10:
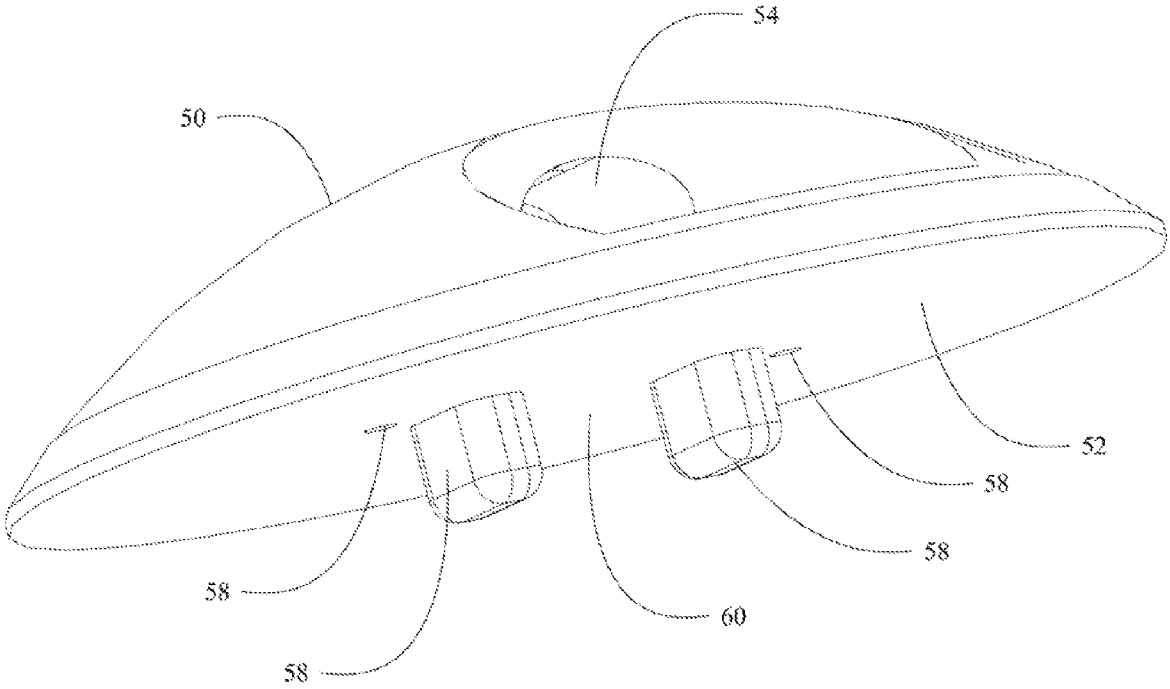
FIG. 10 is an isometric view of an embodiment of the truncated plug employing leash cup inserts.
Figure 11:
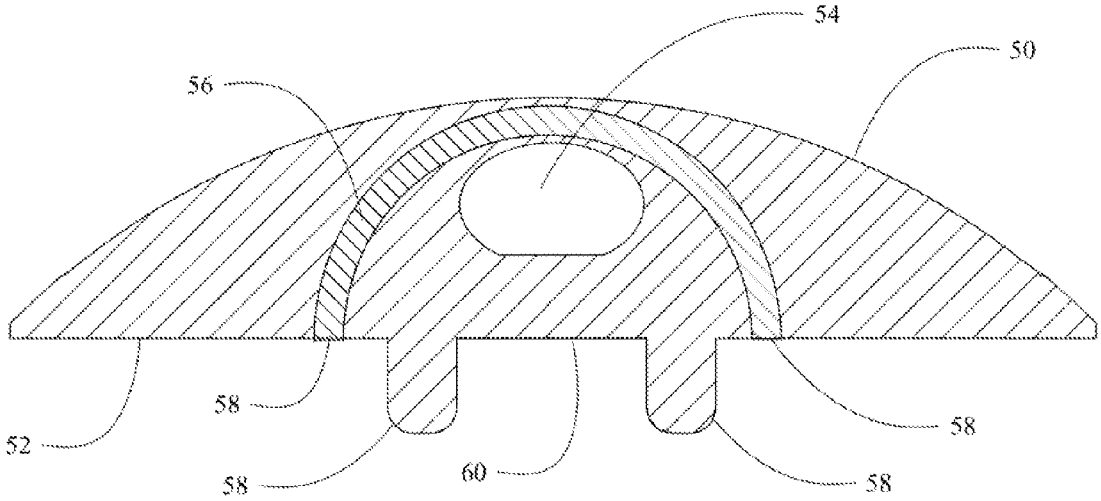
FIG. 11 is a section view of the embodiment of FIG. 10.

For use of the truncated cap embodiment of the invention, many surf boards or other water sports boards have preexisting leash cups. Typically the leash cup is cylindrical opening with an attachment rod diametrically placed across the cup. As shown in FIGS. 10 and 11, depending guide posts 60 are molded into the bottom surface of the cap to extend into the leash cup. The posts are separated by a channel 62 to receive the diametric attachment rod. These structural members provide additional rigidity for the installation and for embodiments in which the cup is filled with adhesive, the posts are fully engaged in the adhesive potting providing resistance to removal forces in shear for greater strength. Sizing of the post length and channel width are varied in alternative embodiments to accomodate various sizes of existing leash cups.

Figure 12:
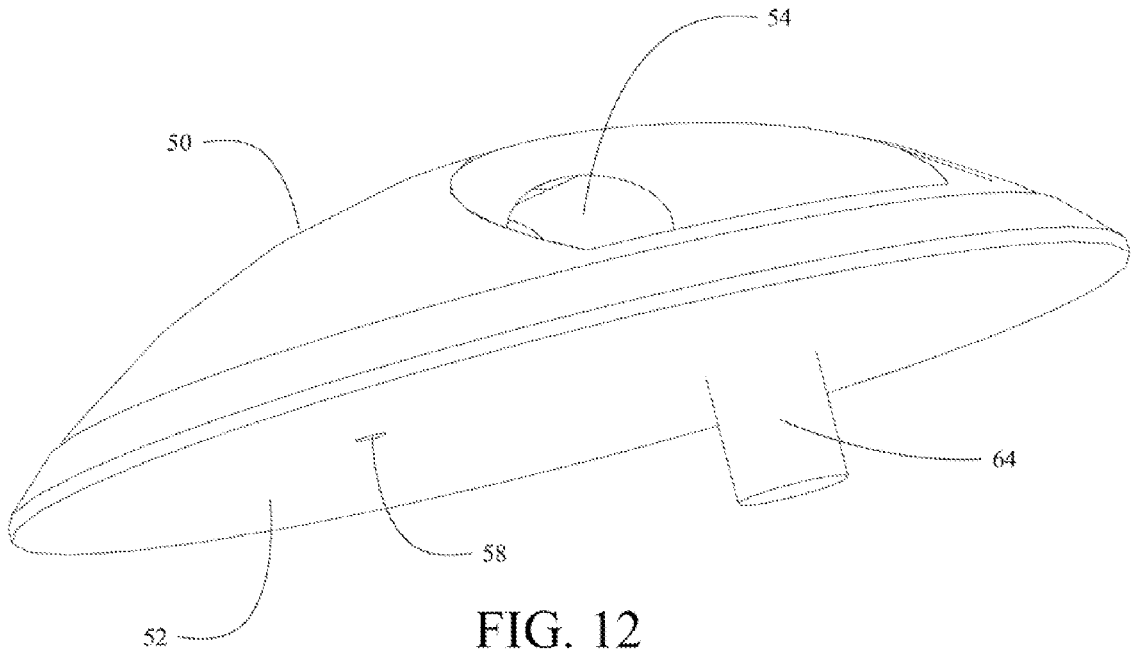
FIG. 12 is an isometric view of an embodiment of the truncated plug employing an insert for fin box leash cord hole; and, FIG. 13 is a section view of the embodiment of FIG. 12.
Figure 13:
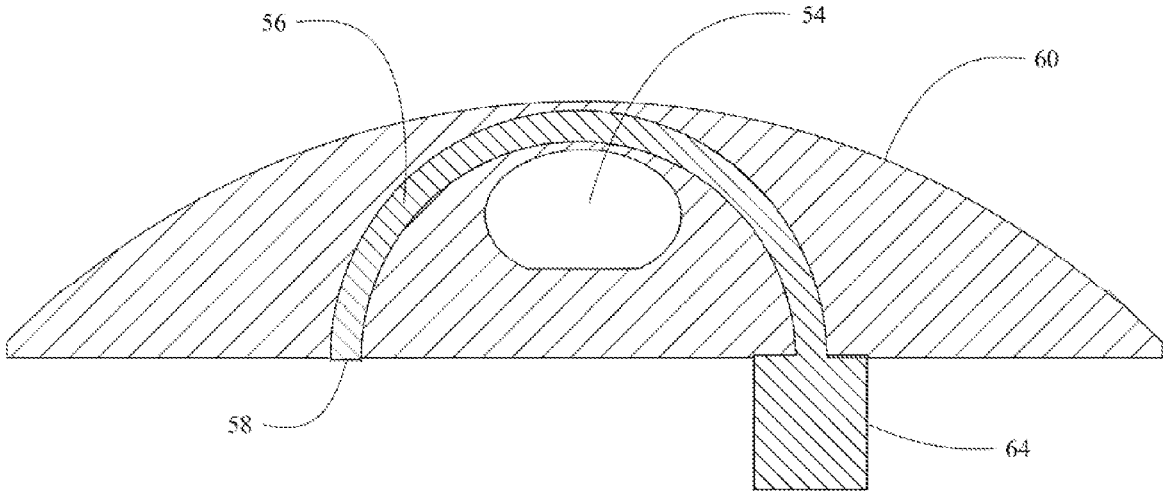

Various water sports boards employ a leash cord hole in the fin box. The embodiment of the present invention shown in FIGS. 12 and 13 provides a cylindrical extension 64 from the structural arch which is received in the leash cord hole. The cylindrical extension again provides additional structural strength for the attachment of the truncated cup and additional adhesive bonding surface with removal forces in shear.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A contoured composite locking system comprising:

an installation cup mountable within a core of a composite structure and having means for engaging the core;

and a contoured plug incorporating a cylindrical body recessed diametrically inward from a circumference of a cap which incorporates a contoured upper surface for the plug received within a cylindrical walled cavity in the installation cup with adhesive boding between a cylindrical surface of the body and the cylindrical wall of the cavity, the plug incorporating an eyelet for a shank of a restraint.

2. A contoured composite locking system as defined in claim 1 wherein the means for engaging the core comprises a plurality of engaging steps formed by spaced reductions in a cylindrical external diameter of the cup.

3. A contoured composite locking system as defined in claim 2 wherein the means for engaging the core further comprises vertical risers incorporated in the cylindrical external diameter of the cup to provide lateral surface area to resist rotational movement of the cup within the composite.

4. A contoured composite locking system as defined in claim 1 wherein the plug incorporates an integral structural ring surrounding the eyelet.

5. A contoured composite locking system as defined in claim 1 wherein the eyelet of the plug is curvilinearly contoured to prevent leveraging surfaces for the restraint.

6. A contoured composite locking system as defined in claim 1 wherein the cup incorporates a flat rim to be sanded flush with an external surface of the composite.

7. A contoured composite locking system as defined in claim 1 wherein cylindrical surface of the body is textured for adhesive.

8. A contoured composite locking system as defined in claim 1 wherein the contoured upper surface is smoothly arcuate to avoid snagging on a users clothing or causing injury to skin or feet during use.

9. A contoured composite locking system as defined in claim 7 wherein the cap includes a land projecting from the body to engage a flat rim of the cup.

10. A contoured composite locking system as defined in claim 7 wherein the cylindrical body of the plug has a length less than a vertical dimension of the cavity in the cup.

11. A contoured composite locking system as defined in claim 7 wherein the plug incorporates relief ports.

12. A contoured composite locking system as defined in claim 7 wherein length of the body and depth of the cup comprise less than 30 percent of a thickness of a core in which the cup is installed.

13. A contoured composite locking system as defined in claim 1 wherein the eyelet includes an excavated portion in the contoured upper surface of the plug.

14. A contoured composite locking system as defined in claim 13 wherein the excavated portion in the contoured upper surface of the plug comprises a toroidal bore.

* * * * *